United States Patent [19]

Olsson

[11] Patent Number: 4,936,372

[45] Date of Patent: Jun. 26, 1990

[54] APPARATUS FOR CONTINUOUS CASTING OF METAL PRODUCTS

[76] Inventor: Erik A. Olsson, Rotfluhstrasse 15, Zollikon, Switzerland

[21] Appl. No.: 306,256

[22] Filed: Feb. 2, 1989

Related U.S. Application Data

[63] Continuation of Ser. No. 163,314, Mar. 2, 1988, abandoned, which is a continuation-in-part of Ser. No. 859,391, May 5, 1986, abandoned.

[30] Foreign Application Priority Data

May 10, 1985 [CH] Switzerland ..... 2005/85

[51] Int. Cl.[5] ..... B22D 11/06

[52] U.S. Cl. ..... 164/437; 164/423; 164/429

[58] Field of Search ..... 164/466, 467, 502, 503, 164/423, 429, 463, 479, 437, 488, 439

[56] References Cited

FOREIGN PATENT DOCUMENTS

| | | | |
|---|---|---|---|
| 692141 | 8/1964 | Canada | 164/463 |
| 1028300 | 4/1958 | Fed. Rep. of Germany | 164/437 |
| 52-32824 | 3/1977 | Japan | 164/467 |

*Primary Examiner*—Kuang Y. Lin

*Attorney, Agent, or Firm*—Helfgott & Karas

[57] ABSTRACT

An apparatus for the continuous casting along a selected direction of metal products wherein a metal melt is solidified on a cooling surface. The spreading of the melt on said surface forms a boundary line between the metal and the cooling surface transverse to the casting direction of the movable cooling surface. The apparatus is provided with a device for controlling the spreading of the melt to change the normal configuration of the boundary line to a different predetermined line configuration. The configuration of the boundary line includes at least one line portion inclined with respect to the perpendicular of the casting direction.

4 Claims, 2 Drawing Sheets

APPARATUS FOR CONTINUOUS CASTING OF METAL PRODUCTS

CROSS REFERENCE TO COPENDING APPLICATION

This is a continuation application of Ser. No. 163,314 filed Mar. 2, 1988 which in turn was a continuation-in-part of Ser. No. 859,391 filed May 5, 1986, both now abandoned.

BACKGROUND OF THE INVENTION

This invention relates to an apparatus for the continuous casting of metal products.

Many of the defects occurring on the surfaces of continuously cast metal products consist of cracks in the primary solidifying crust and are due to natural shrinkage of the metal crust during cooling. Other factors causing such defects are too much friction between the crust and the chilling wall as well as the internal static pressure of the metal acting on the crust, such as typically occurs in casting into both open and closed molds. The crust can fracture in all directions in which shrinkage is impeded, unless the elasticity of the material at the correspondingly elevated temperatures is sufficient to completely prevent such cracks from occurring. However, this cannot be expected in the majority of cases.

Problems with surface defects especially arise in the casting of thin layers on rotating cooled cylinders and belts or the like, as is known in the prior art, although the internal static pressure of the metal on the solidifying crust is usually of secondary importance. For these reasons the required widthwise extension of thin layers plays a dominant role. The amount of shrinkage depends on the width which the cast product is to have. Although a lubricant may be introduced between the solidifying crust and the cooling surface, it is technically expensive and there is no assurance that the layer will shrink without fractures occurring transverse or parallel to the casting direction. In the majority of cases any weak area is adequately sealed by the cooling surface which accompanies the layer in its movement until it has completely solidified to prevent the melt from breaking through. However, surface defects such as cracks lead to rejects since there can obviously be no possibility of removing such defects by chiseling or grinding.

Swiss Patent No. 604,970 discloses a process in which the spreading of the melt on a shaping wall, i.e., a cooling wall, is controlled by the use of electromagnetic forces. However, this process is used exclusively to prevent the metal from penetrating the gap between the fixed side walls and the mold wall during the casting of metal strips.

All known continuous casting processes in which thin layers are cast onto rotating cooling surfaces, share the feature where mechanical boundary elements are missing that the wetting of the cooling surface by the metal has a natural boundary line extending transverse to the casting direction and produced by gravity. The natural boundary line at the same time is the beginning of the solidification extending in the casting direction.

SUMMARY OF THE INVENTION

The invention relates to the prevention of surface defects in the form of cracks or scars of cracks refilled with melt in the continuous casting of metal products and to enhancing the operational reliability of casting plants and their productivity.

The apparatus according to the present invention comprises means for providing a boundary line between the melt and the cooling surface transverse to the casting direction and in the plane of the cooling surface, a configuration which differs from the natural course. The boundary line will include at least one line portion at an inclination to the perpendicular of the casting direction. Further preferred forms of boundary lines are zig-zag or undulating shapes. As a result, the stresses set up in the crust during solidification no longer follow a definite course extending across the width of the casting in a way which normally causes longitudinal cracks. On the contrary shrinkage is gradually and successively compensated by solidifying melt. Shrinkage also takes place over a longer distance than that corresponding to the perpendicular to the casting direction, thus preventing the crust from being stretched beyond the permissible limits.

DETAILED DESCRIPTION OF THE PREFERRED EMBODIMENTS

Figure 1:
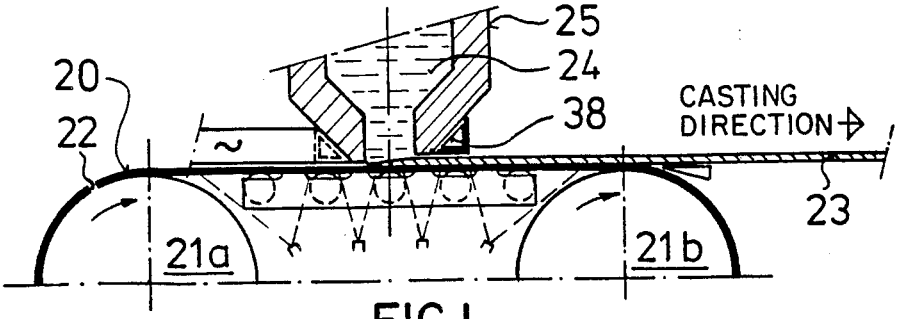
FIG. 1 is a longitudinal section through an apparatus with a rotating cooling surface in accordance with an embodiment of the invention.
Figure 2:
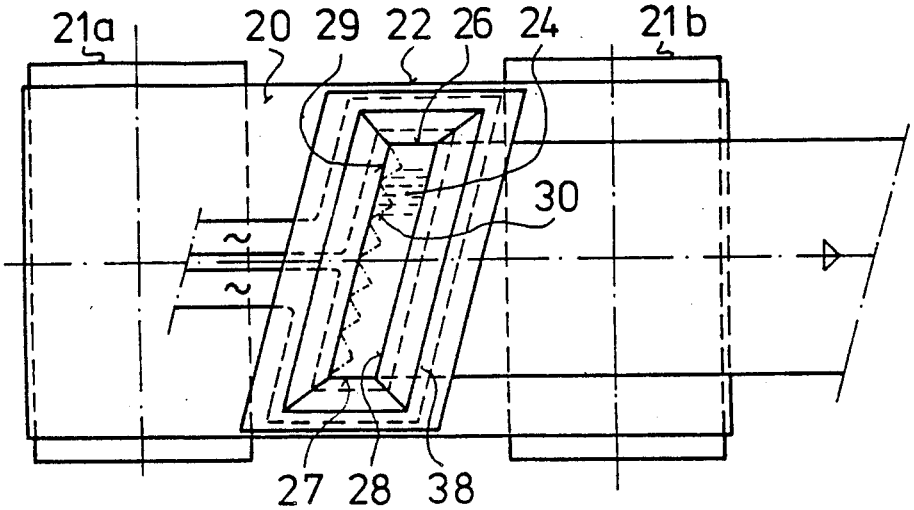
FIG. 2 is a plan view of the apparatus shown in FIG. 1.

FIGS. 1 and 2 show an apparatus having a travelling cooling surface 20 in the form of a belt 22, driven and guided by a pair of rollers 21*a* and 21*b* to produce a very thin layer 23. The melt 24 solidifies almost immediately on contact with the cooling surface to provide a thin product. This operation results in an almost instantaneous shrinkage of layer 23 wherein the frictional forces between the layer and the cooling surface 20 normally causes longitudinal cracks. This embodiment also shows a melt container 25 through which the melt 24 is supplied and uniformly distributed over the belt 22, its walls 26, 27 and 28 insuring the limitation of the spread of cooling surface 20. A boundary line 29, identical with that of the wall opposite to the casting direction shown by arrow is preferably disposed at an inclination thereto. This on its own can completely exclude the risk of formation of longitudinal cracks in the majority of cases since the shrinkage of the layer being produced extends at an angle to the boundary line 29. Of course, the boundary line can have a shape according to line 30 similar to or identical with lines 40 and 41 shown in FIGS. 4*a* and 4*b* respectively.

Figure 3:
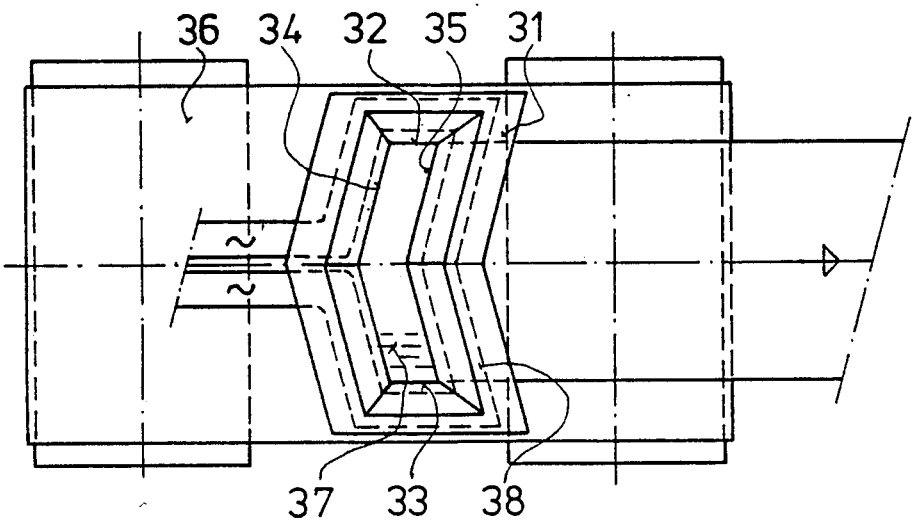
FIG. 3 is a plan view of an apparatus similar to that shown in FIG. 2 as an additional embodiment.

FIG. 3 shows an arrangement similar to the previous embodiment in which a melt container 31 has arrow shaped walls 32, 33, 34 and 35 to limit the wetting of the cooling surface 36 by melt 37. It can be clearly seen that the resistance of the material to shrinkage is substantially improved if the boundary line is longer than the width of the layer, as measured perpendicular to the casting direction.

An electric conductor 38, for producing an electromagnetic field can be disposed in a suitable manner to prevent the metal from penetrating the gap between the fixed side walls and the cooling surface 20 or the top of the layer 23, respectively.

Figure 4A:
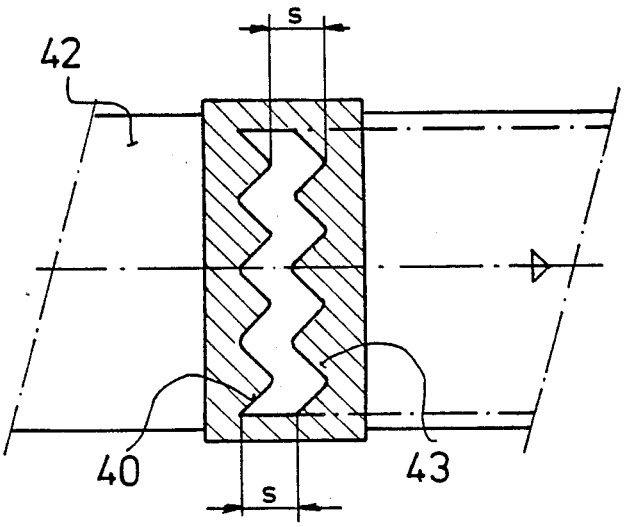
FIGS. 4*a* and 4*b* illustrate preferred shapes of the boundary line.
Figure 4B:
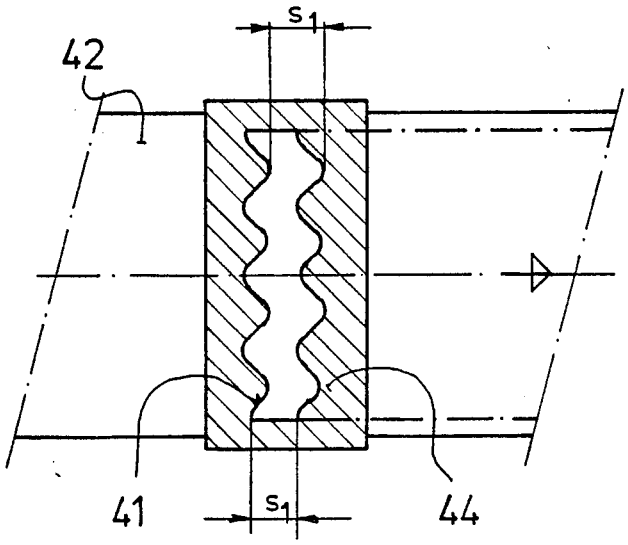

FIGS. 4*a* and 4*b* further show preferred boundary lines 40, 41 which are convenient for avoiding longitudinal cracks. The boundary line is determined by by the contour of the walls themselves limiting the spread of the cooling surface by the metal in accordance with the invention.

However, it is important for each of walls 43, 44 adjacent to the casting direction to be shaped as a mating surface in relationship to the surface of the opposite wall. This ensures that the solidification distances s, s1 and therefore the solidification times of each longitudinal section remain identical, the result being a layer of uniform thickness. In some circumstances the solidification distances s, s1 can have an extension of only a few millimeters, particularly if very thin layers with extremely short complete solidification times are cast, for example, in the production of a material having an amorphous structure.

What is claimed is:

1. Apparatus for the continuous casting of metal products comprising:

a melt container for producing and discharging a metal melt;

a device including a cooling surface for receiving said melt from said melt container and solidifying said melt on said cooling surface, wherein spreading of the metal melt on said cooling surface forms a boundary line between the melt and the cooling surface transverse to a casting direction defined by said cooling surface and which is normal to a direction of discharging of said melt onto said cooling surface; and means for simultaneously controlling the spreading of the melt on the cooling surface to provide a predetermined line configuration of said boundary line, said configuration including at least one line portion inclined with respect to a perpendicular of the casting direction on said cooling surface.

2. Apparatus as set forth in claim 1, wherein the controlling means includes at least one pair of oppositely disposed walls formed on said container, said walls being arrow shaped, and wherein the walls have adjacent surfaces configured to mate with each other.

3. Apparatus as set forth in claim 1, wherein the melt container includes at least one pair of oppositely disposed walls which have a zig-zag shape and wherein the walls have adjacent surfaces configured to mate each other.

4. Apparatus according to claim 3, wherein the walls have an undulated shape.

* * * * *